US007105945B2

(12) United States Patent
Shiotsu et al.

(10) Patent No.: US 7,105,945 B2
(45) Date of Patent: Sep. 12, 2006

(54) LIGHTING DEVICE FOR VEHICLE

(75) Inventors: Fuminori Shiotsu, Shizuoka (JP); Masayasu Ito, Shizuoka (JP); Toshiyuki Tsuchiya, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 11/040,286

(22) Filed: Jan. 21, 2005

(65) Prior Publication Data

US 2005/0162858 A1 Jul. 28, 2005

(30) Foreign Application Priority Data

Jan. 23, 2004 (JP) ..... 2004-016030

(51) Int. Cl.
*B60L 1/14* (2006.01)
*B60Q 1/14* (2006.01)

(52) U.S. Cl. ..... 307/10.8; 307/77

(58) Field of Classification Search ..... 315/77, 315/82, 291, 307, 308; 307/10.1, 10.8; 362/487
See application file for complete search history.

(56) References Cited

U.S. PATENT DOCUMENTS 4,100,476 A * 7/1978 Ghiringhelli ..... 315/297
5,349,272 A * 9/1994 Rector ..... 315/294
6,847,169 B1 * 1/2005 Ito et al. ..... 315/77
6,876,153 B1 * 4/2005 Ito et al. ..... 315/82

FOREIGN PATENT DOCUMENTS

JP 2002-231013 8/2002
JP 2003-187614 7/2003
JP 2003-317978 11/2003

OTHER PUBLICATIONS

Patent Abstracts of Japan, Publication No. 2002-231013, Publication Date Aug. 16, 2002, 2 pages.
Patent Abstracts of Japan, Publication No. 2003-317978, Publication Date Nov. 7, 2003, 2 pages.
Patent Abstracts of Japan, Publication No. 2003-187614, Publication Date Jul. 4, 2003, 2 pages.

* cited by examiner

*Primary Examiner*—Thuy Vinh Tran
(74) *Attorney, Agent, or Firm*—Osha Liang L.L.P.

(57) ABSTRACT

A lighting device for a vehicle comprises: a plurality of light source sections connected in parallel with each other; and a transformer for supplying an electric power to the plurality of light source sections. The transformer includes a primary coil and a plurality of secondary coils provided corresponding to the plurality of light source sections, for respectively supplying electric power to the corresponding light source sections. One end of each light source section is grounded and a semiconductor light emitting element is provided between one end and the other end of the light source section. The lighting device further comprises: a voltage detecting section for detecting voltages at the other ends of the plurality of light sources; and an output control section for controlling an electric current outputted from the transformer according to the voltage detected by the voltage detecting section.

8 Claims, 2 Drawing Sheets

LIGHTING DEVICE FOR VEHICLE

This application claims foreign priority based on Japanese patent application JP 2004-016030, filed on Jan. 23, 2004, the contents of which is incorporated herein by reference in its entirety.

BACKGROUND OF THE INVENTION

1. Field of the Invention

The present invention relates to a lighting device for a vehicle.

2. Description of the Related Art

In a related art, a lighting device for a vehicle uses a light emitting diode element (for example, refer to JP-A-2002-231013). In some cases, a plurality of light emitting diode elements are used for the lighting device for the vehicle.

In the lighting device for the vehicle, from the viewpoint of securing safety, even when one light emitting diode element is out of order, it is desired that the other light emitting diode element is turned on as far as it is possible. However, in some cases, depending on a failure mode of the light emitting diode element, it is safer that all the light emitting diode elements are turned off. Therefore, in the lighting device for the vehicle, it is desired to conduct a lighting control depending on the failure mode.

SUMMARY OF THE INVENTION

It is an object of the present invention to provide a lighting device for a vehicle by which the above problems can be solved.

While the foregoing object is provided for the present invention, it is not necessary for the object to be achieved in order for the invention to operate properly. Further, other object, or no objects at all, may be achieved by the present invention without affecting its operation.

In order to solve the above problems, a lighting device for a vehicle according to the present invention comprises:

a plurality of light source sections connected in parallel with each other; and a transformer for supplying an electric power to the plurality of light source sections, the transformer including a primary coil, and a plurality of secondary coils provided corresponding to the plurality of light source sections, for respectively supplying the electric power to the corresponding light source sections.

In the above-mentioned lighting device, each of the light source sections may include a semiconductor light emitting element provided between one end and the other end of the light source section, and the one end of each light source section may be grounded. The lighting device may further comprises: a voltage detecting section for detecting voltages at the other ends of the plurality of light source sections; and an output control section for controlling an electric current outputted from the transformer according to the voltage detected by the voltage detecting section, wherein the output control section stops an output of the transformer in the case where the voltage at the other end in either light source section becomes lower than a previously set value.

A lighting device for a vehicle may further comprise a plurality of series resistors provided corresponding to the respective light source sections, respectively connected in series to the corresponding light source sections on one end side which is grounded, wherein the output control section controls an output voltage of the transformer so that a voltage generated at both end portions of the series resistor can be equal to a setting voltage commonly determined with respect to the plurality of series resistors.

The voltage detecting section may detect an average value of the voltages at the respective other ends as the voltage at the other ends of the plurality of light source sections. The voltage detecting section may detect the lowest voltage in the voltages of the other ends as the voltage of the other ends of the plurality of light source sections.

In this connection, the summary of the invention described above does not enumerate all characteristics necessary for the present invention. The sub-combination of the characteristics can become the present invention.

DETAILED DESCRIPTION OF THE INVENTION

Hereinafter, an exemplary, non-limiting embodiment of the invention will be explained with reference to the accompanying drawings. In the present invention, terms are presumed to have their ordinary meaning as would be understood by one of ordinary skill in the relevant art. However, terms may also be operationally defined in this disclosure to have a specific meaning.

Further, it should be noted that the following embodiment does not restrict the invention described in claim. It should be also noted that all combinations of the characteristics explained in the embodiment are not necessarily indispensable to the means for solution of the invention.

Figure 1:
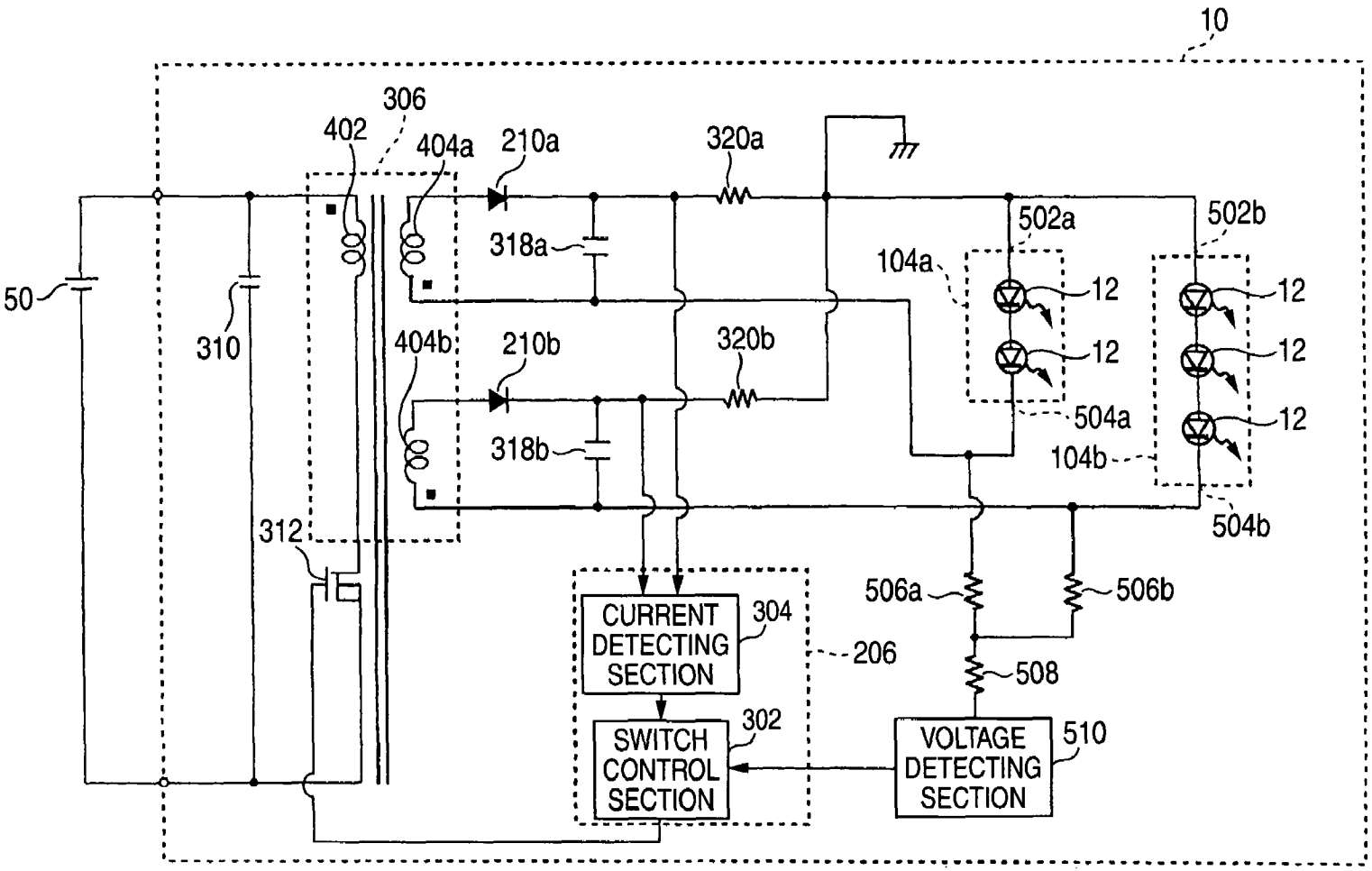
FIG. 1 is a view showing an example of the constitution of a lighting device 10 for a vehicle according to an exemplary, non-limiting embodiment of the present invention.

FIG. 1 is a view showing an example of the constitution of a lighting device 10 for a vehicle according to the exemplary, non-limiting embodiment of the present invention. In FIG. 1, the lighting device 10 for the vehicle is shown together with a reference voltage power supply 50. The reference voltage power supply 50 is, for example, a battery mounted on the vehicle. The reference voltage power supply 50 supplies a DC voltage to the lighting device 10 for the vehicle. The lighting device 10 for the vehicle of the embodiment properly lights a plurality of light source sections 104*a*, 104*n*. The lighting device 10 for the vehicle of the embodiment includes: the plurality of light source sections 104*a*, 104*b*; a condenser 310; a switching element 312; a transformer 306; a plurality of diodes 210*a*, 210*b*; a plurality of condensers 318*a*, 318*b*; a plurality of series resistors 320*a*, 320*b*; a plurality of resistors 506*a*, 506*b*, 508; a voltage detecting section 510; and an output control section 206.

The plurality of light source sections 104*a*, 104*b* are connected in parallel with each other. The end portion 502 which is one end of each light source section 104 is grounded. One or more light emitting diode elements 12 are provided between the end portion 502 and the end portion 504 which is the other end of each light source section 104. The light emitting diode element 12 is an example of the semiconductor light emitting element. Therefore, the light emitting diode element 12 emits light according to the electric power supplied from the transformer 306. The light source sections 104*a*, 104*b* may have light emitting diode elements 12, the numbers of which are different from each other. The light source sections 104*a*, 104*b* may have a plurality of light source rows connected in parallel to each other. The light source row is defined, for example, as a row of one or more light emitting diode elements 12 connected in series.

The condenser 310 smoothens the voltage to be received by the transformer 306 from the reference voltage power supply 50. The switching element 312 is connected with the primary coil 402 of the transformer 306 in series. When the switching element 312 is turned on and off according to the control of the output control section 206, an electric current flowing in the primary coil 402 is intermittently changed. Thus, the switching element 312 composes a switching regulator together with the transformer 306.

The transformer 306 includes: a primary coil 402; and a plurality of secondary coils 404*a*, 404*b*. In the case where the switching element 312 is turned on, an electric current received from the reference voltage power supply 50 flows in the primary coil 402. The plurality of secondary coils 404*a*, 404*b* are provided corresponding to the plurality of light source sections 104*a*, 104*b*. The plurality of secondary coils 404*a*, 404*b* respectively supply electric power according to the electric current flowing in the primary coil 402 to the corresponding light source section 104 via the diode 210. Thus, the transformer 306 supplies electric power to the plurality of light source sections 104*a*, 104*b*. The plurality of secondary coils 404*a*, 404*b* may respectively wound by the numbers of turns which are different from each other. In this case, the secondary coils 404*a*, 404*b* respectively output voltage different from each other according to the number of turns.

In the embodiment, the end portion 502, which is grounded in the light source section 104, is an upstream end of the light source section 104. Therefore, in the embodiment, the secondary coil 404 supplies a negative polarity voltage to the corresponding light source section 104. Alternatively, for example, a downstream end of the light source section 104 may be grounded. In this case, the secondary coil 404 supplies a positive polarity voltage to the light source section 104.

Here, for example, it can be considered that an output voltage of one secondary coil 404 is supplied to the plurality of light source sections 104. However, in this case, it becomes necessary that the respective light source sections 104 are selected in order and connected to the secondary coil 404. Further, in order to properly light the respective light source sections 104, it becomes necessary to control not to simultaneously select the plurality of light source sections 104. Therefore, the lighting control becomes complicated. On the other hand, according to the present embodiment, it is possible to properly control lighting of the plurality of light source sections 104 without conducting the aforementioned complicated control. Thus, it is possible to provide a lighting device 10 for a vehicle at a low manufacturing cost.

A plurality of diodes 210*a*, 210*b*, condensers 318*a*, 318*b* and series resistors 320*a*, 320*b* are provided corresponding to the plurality of light source sections 104*a*, 104*b*. The diode 210 is used for rectification and connected between the corresponding secondary coil 404 and the light source section 104 in the forward direction. The condenser 318 smoothens an electric current flowing in the corresponding light source section 104. The series resistor 320 is connected to the light source section 104 in series on the end portion 502 side which is grounded. Therefore, at both end portions of the series resistor 320, voltage is generated according to the electric current flowing in the corresponding light source section 104.

The plurality of resistors 506*a*, 506*b* are provided corresponding to the plurality of light source sections 104*a*, 104*b* and connect the end portion 504 in the corresponding light source section 104 with the resistor 508. One end of the resistor 508 is connected to the plurality of resistors 506*a*, 506*b*, and the other end of the resistor 508 is connected to the voltage detecting section 510. Thus, the resistor 508 connects the plurality of resistors 506*a*, 506*b* to the voltage detecting section 510.

The plurality of resistors 506*a*, 506*b* and the resistor 508 supply an average value of the voltages at the end portions 504 of the plurality of light source sections 104*a*, 104*b* to the voltage detecting sections 510. The voltage at the end portion 504 is, for example, an absolute value of the electric potential of the end portion 504. It is preferable that the impedance of the resistor 506 is relatively low. The resistance value of the resistor 506 may be, for example, about 200 to 1 kΩ. In this case, it is possible for the plurality of resistors 506*a*, 506*b* and the resistor 508 to supply an average value of the voltages of the end portions 504 to the voltage detecting section 510 with high accuracy.

The voltage detecting section 510 detects the voltage at the end portions 504 of the plurality of light source sections 104 and sends it to the switch control section 302. In the embodiment, the voltage detecting section 510 is connected to the end portions 504 of the respective light source sections 104 via the resistors 508, 506*a*, 506*b*. Therefore, the voltage detecting section 510 detects an average value of the voltages of the respective end portions 504 as the voltage of the end portions 504 of the plurality light source sections 104.

The voltage detecting section 510 may detect the lowest voltage in the voltages of the respective end portions 504 as the voltage of the end portions 504 of the plurality of light source sections 104. In this case, the voltage at the end portions 504 is, for example, an absolute value of the electric potential of the end portion 504. In this case, the lighting device 10 is provided with, for example, a plurality of diodes instead of the plurality of resistors 506*a*, 506*b*. For example, in the case where the secondary coil 404 outputs a positive polarity voltage, these diodes are provided corresponding to the plurality of light source sections 104 and connected in the forward direction being directed from the resistor 508 to the light source section 104 so that the cathodes of these diodes can be connected to the corresponding light source sections 104.

The output control section 206 includes a current detecting section 304 and the switch control section 302. The current detecting section 304 detects the voltage generated at both end portions of each series resistor 320, more specifically, detects an electric current flowing in the light source section 104 corresponding to the series resistor 320.

The switch control section 302 controls the time at which the switching element 312 is turned on and off, for example, by the well known PWM control or PFM control according to the electric current detected by the current detecting section 304. The switch control section 302 controls the switching element 312 so that the electric current detected by the current detecting section 304 can be constant. Thus, the output control section 206 controls an electric current to be outputted from the transformer 306.

In the embodiment, the switch control section 302 also controls the switching element 312 according to the voltage detected by the voltage detecting section 510. For example, in the case where the voltage of the end portion 504 in either light source section 104 becomes lower than a value which has been previously set, the switch control section 302 maintains the switching element 312 so that it can be turned off. Thus, the output control section 206 stops an output from the transformer 306.

In this case, the end portion 504 is a terminal which receives an electric potential, the absolute value of which is high, in the light source section 104. Therefore, in the case where the end portion 504 is grounded, a ground current with a high intensity flows. Accordingly, there is a possibility that the light emitting diode element 12 and other circuits are thermally damaged, smoked and burnt. However, according to the present embodiment, in the case where the voltage at the end portion 504 in either light source section 104 is decreased, the output control section 206 stops an output from the transformer 306, so that the operation of the entire lighting device 10 for the vehicle can be stopped. Therefore, according to the present embodiment, even when the problem of grounding is caused, an appropriate fail-safe operation can be conducted in the lighting device 10 for the vehicle. Thus, it is possible to provide a highly safe lighting device 10 for a vehicle.

Here, it can be considered that the grounding of the end portion 504 is detected according to the voltage generated at both end portions of the series resistor 320. In this case, when the voltage at both end portions of the series resistor 320 is substantially reduced to zero, the operation of the lighting device 10 for the vehicle is stopped. However, the voltage at both end portion of the series resistor 320 substantially becomes zero not only in the case of the grounding of the end portion 504 but also in the case where the corresponding light source section 104 is in the open state. The open state of the light source section 104 is defined as a state of high impedance between the end portion 502 and the end portion 504 of the light source section 104, for example, due to the breaking of wire. Therefore, in this case, when either light source section 104 is in the open state, the operation of the entire lighting device 10 for the vehicle is stopped.

However, in the case where the light source section 104 is put into the open state, since the problem of the ground current is not caused, there is no possibility of thermal damage, smoking and burning of the elements and other circuits. In this case, in the lighting device 10 for the vehicle, for example, from the viewpoint of securing safety, it is preferable that the other light source sections 104, which are not in the open state, are not turned off but turned on.

In the present embodiment, the voltage of the end portion 504 is not decreased, for example, in the case where the corresponding light source section 104 is put into the open state. Therefore, in the present embodiment, even when either light source section 104 is put into the open state, the transformer 306 keeps supplying electric power to the other light source sections 104, and thus, normal lighting operation of the light source section 104 can be maintained. According to the present embodiment, it is possible to properly distinguish between the grounding of the end portion 504 and the open state of the light source section 104. Thus, it is possible to properly conduct the control of lighting operation according to the failure mode.

In the present embodiment, the end portions 504*a*, 504*b* of the plurality of light source sections 104*a*, 104*b* are connected with each other via the plurality of resistors 506*a*, 506*b*. In this case, even when either light source section 104 is put into the open state, the secondary coil 404 corresponding to the light source section 104 is not put into the state of no load. Therefore, according to the embodiment, it is possible to prevent an output of the secondary coil 404 corresponding to the light source section 104, which has been put into the open state, from rising extremely high. Therefore, according to the present embodiment, the fail-safe control can be properly conducted in the lighting device 10 for the vehicle.

Figure 2:
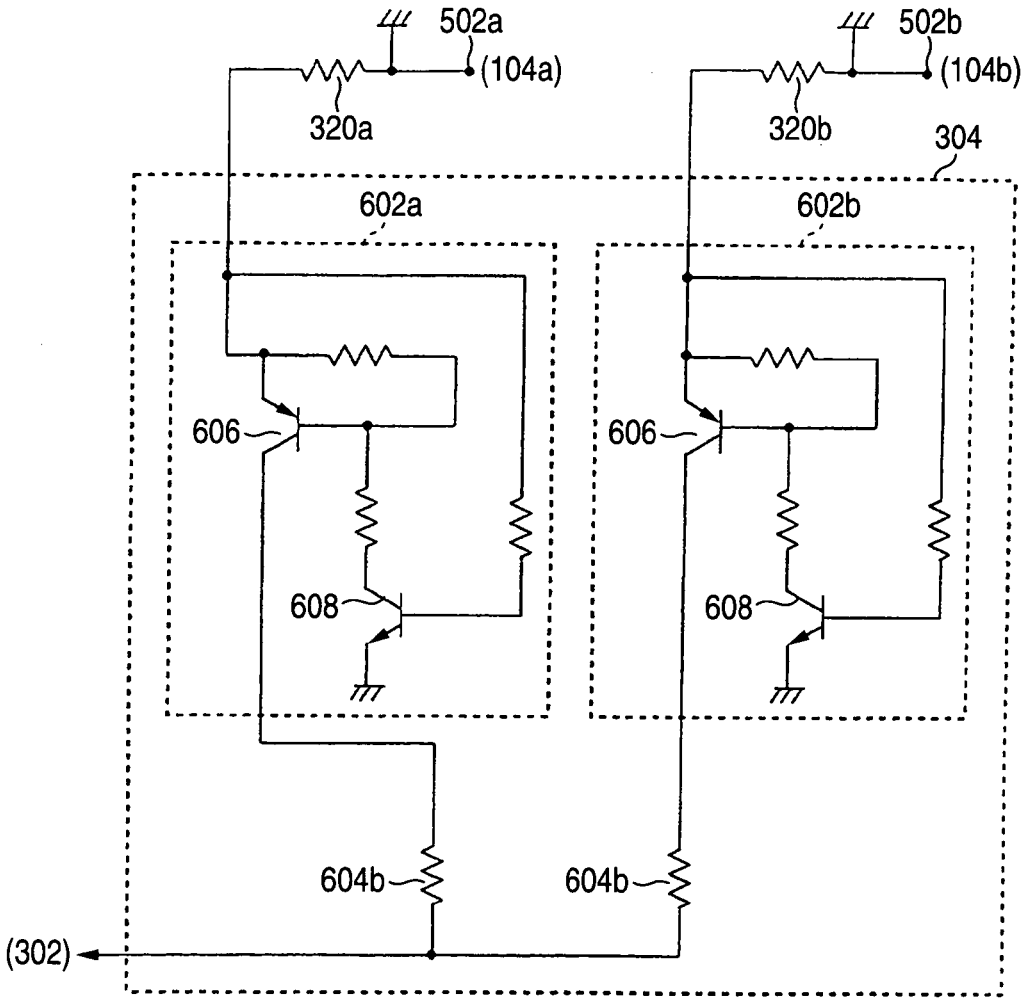
FIG. 2 is a view showing an example of the constitution of a current detecting section 304.

FIG. 2 is a view showing an example of the current detecting section 304 together with the plurality of series resistors 320*a*, 320*b*. In the embodiment, the current detecting section 304 includes a plurality of broken wire detecting sections 602*a*, 602*b* and resistors 604*a*, 604*b* which are provided corresponding to the plurality of light source sections 104*a*, 104*b*.

The broken wire detecting section 602 includes PNP transistor 606, NPN transistor 608 and a plurality of resistors. A base terminal of PNP transistor 606 is connected to an emitter terminal via the resistor, and the emitter terminal is connected to an end portion of the corresponding series resistor 320 distant from the light source section 104. A collector terminal is connected to the corresponding resistor 604. Abase terminal of NPN transistor 608 is connected to the end portion of the corresponding series resistor 320 distant from the light source section 104. A collector terminal is connected to the base terminal of PNP transistor 606 via the resistor. An emitter terminal of NPN transistor 608 is grounded. The resistor 604 connects the collector terminal of PNP transistor 606 in the corresponding broken wire detecting section 602 with the switch control section 302.

Therefore, in the case where the corresponding light source section 104 is not in the open state, the electric potential of the end portion of the series resistor 320 distant from the light source section 104 is the product of the value of the electric current flowing in the light source section 104 and the value of resistance of the series resistor 320. In this case, NPN transistor 608 and PNP transistor 606 are turned on. Therefore, the resistor 604 receives a voltage, which is generated at both end portions of the series resistor 320, from the broken wire detecting section 602.

In the case where the corresponding light source section 104 is in the open state because of the breaking of wire and others, no electric current flows in the series resistor 320. Therefore, an electric potential of the end portion of the series resistor 320 distant from the light source section 104 becomes the ground potential. In this case, NPN transistor 608 and PNP transistor 606 are turned off. Therefore, the resistor 604 receives high impedance from the broken wire detecting section 602.

Thus, none of the light source sections 104*a*, 104*b* is in the open state, the current detecting section 304 supplies an average value of the voltages generated at both end portions of the series resistors 320*a*, 320*b* to the switch control section 302 as a value of the electric current detected. In the case where either light source section 104*a*, 104*b* is in the open state, the current detecting section 304 supplies a voltage generated at both end portions of the series resistor 320 corresponding to the light source section 104, which is not in the open state, to the switch control section 302 as a value of the electric current detected. The switch control section 302 controls the switching element 312 (shown in FIG. 1) so that the voltage received from the current detecting section 304 can be constant.

In the embodiment, the respective series resistors 320 have a value of resistance that can be a reciprocal ratio with respect to the ratio of the electric currents flowing in the corresponding light source sections 104. Therefore, in the embodiment, the respective series resistors 320 generate the substantially same voltage according to the electric current flowing in the corresponding light source sections 104. Therefore, according to the embodiment, when the control is conducted so that an average value of the voltages generated at both end portions of the series resistors 320 can be equal to the setting voltage which is commonly determined with respect to the plurality of series resistors 320, electric currents flowing in the plurality of light source sections 104*a*, 104*b* can be properly controlled. The output control section 206 (shown in FIG. 1) may control an output voltage of the transformer 306 (shown in FIG. 1) so that the voltage generated at both end portions of the respective series resistors 320 can be equal to the setting voltage. According to the present embodiment, even when either light source section 104 is put into the open state, the lighting of the other light source sections 104 can be properly maintained. Accordingly, it is possible to provide a lighting device 10 for a vehicle with a high redundancy for a failure.

In the case where the lighting device 10 for the vehicle (shown in FIG. 1) has three or more lighting sources 104 and either light source section 104 is put into the open state, the current detecting section 304 may supply an average value of the voltages, which are generated at both end portions of the series resistor 320 corresponding to the light source section 104 not in the open state, to the switch control section 302. Alternatively, the current detecting section 304 may supply the sum of the voltage, which is generated at both end portions of the respective series resistors 320, to the switch control section 302.

Further, it can be considered that the plurality of light source sections 104 are lit by controlling the voltage to be supplied to the respective light source sections 104. However, in this case, control becomes complicated due to the fluctuation of the forward voltage of the light emitting diode elements 12 (shown in FIG. 1). However, according to the present embodiment, when the electric currents flowing in the respective light source sections 104 are controlled, the plurality of light source sections 104 can be properly lit.

In the present embodiment, the node provided between the series resistor 320 and the light source section 104 is grounded. In this case, it is possible to prevent the voltage, which is generated by the series resistor 320, from affecting the end portion 504 (shown in FIG. 1) of the light source section 104. Therefore, according to the embodiment, the grounding of the end portion 504 can be properly detected without using the electric current flowing in the series resistor 320. Thus, it is possible to provide a highly safe lighting device 10 for a vehicle.

The present invention has been explained above referring to the embodiment. However, it should be noted that the present invention is not limited to the above specific embodiment. Variations may be made by those skilled in the art. It is clear that the varied or improved embodiments are included in the technical scope of the present invention.

What is claimed is:

1. A lighting device for a vehicle comprising:

a plurality of light source sections; and a transformer for supplying an electric power to the plurality of light source sections, the transformer including a primary coil, and a plurality of secondary coils provided corresponding to the plurality of light source sections, for respectively supplying the electric power to the corresponding light source sections, wherein the plurality of light source sections and the transformer are connected in parallel, and one end of each of the plurality of light source sections is grounded.

2. A lighting device for a vehicle according to claim 1, wherein each of the light source sections includes a semiconductor light emitting element provided between one end and the other end of the light source section, and said lighting device further comprising:

a voltage detecting section for detecting a voltage at said other ends of the plurality of light source sections; and an output control section for controlling an electric current outputted from the transformer according to the voltage detected by the voltage detecting section, wherein the output control section stops an output of the transformer in the case where the voltage at said other end in either light source section becomes lower than a previously set value.

3. A lighting device for a vehicle according to claim 2, further comprising:

a plurality of series resistors provided corresponding to the respective light source sections, respectively connected in series to the corresponding light source sections on one end side which is grounded, wherein the output control section controls an output voltage of the transformer so that a voltage generated at both end portions of the series resistor is equal to a setting voltage commonly determined with respect to the plurality of series resistors.

4. A lighting device for a vehicle according to claim 2, wherein the voltage detecting section detects an average value of the voltages at the respective other ends as the voltage at the other ends of the plurality of light source sections.

5. A lighting device for a vehicle according to claim 2, wherein the voltage detecting section detects a lowest voltage in the voltages of the other ends as the voltage of the other ends of the plurality of light source sections.

6. A lighting device for a vehicle according to claim 1, wherein each of the plurality of light source sections includes a semiconductor light emitting element provided between one end and the other end of the light source section.

7. A lighting device for a vehicle according to claim 1, further comprising a voltage detecting section for detecting a voltage at said other ends of the plurality of light source sections; and an output control section for controlling an electric current outputted from the transformer according to the voltage detected by the voltage detecting section.

8. A lighting device for a vehicle according to claim 1, further comprising a voltage detecting section for detecting a voltage at said other ends of the plurality of light source sections; and an output control section for controlling an electric current outputted from the transformer according to the voltage detected by the voltage detecting section, wherein the output control section stops an output of the transformer in the case where the voltage at said other end in either light source section becomes lower than a previously set value.

* * * * *